United States Patent [19]

Schlemenat et al.

[11] Patent Number: 4,852,644

[45] Date of Patent: Aug. 1, 1989

[54] TUBULAR HEAT EXCHANGER

[75] Inventors: Alfred Schlemenat, Dornchen; Helmut David, Oberhausen, both of Fed. Rep. of Germany

[73] Assignee: Man Gutehoffnungshuette GmbH, Fed. Rep. of Germany

[21] Appl. No.: 126,748

[22] Filed: Nov. 30, 1987

[30] Foreign Application Priority Data

Nov. 29, 1986 [DE] Fed. Rep. of Germany ..... 3640970

[51] Int. Cl.[4] ..... F28F 9/02

[52] U.S. Cl. ..... 165/158; 165/133; 165/163; 165/906

[58] Field of Search ..... 165/158, 163, 906, 133

[56] References Cited

U.S. PATENT DOCUMENTS

| | | | |
|---|---|---|---|
| 139,908 | 6/1873 | McNeill et al. | 165/163 |
| 1,617,519 | 2/1927 | Hartmann | 165/158 |
| 1,655,086 | 1/1928 | Blanding | 165/163 |
| 3,294,159 | 12/1966 | Koualik et al. | 165/158 X |
| 3,521,706 | 7/1970 | Schaefer et al. | 165/158 X |
| 3,712,371 | 1/1973 | Haar et al. | 165/163 |
| 4,368,778 | 1/1983 | Nishimiura et al. | 165/158 |

FOREIGN PATENT DOCUMENTS

| | | | |
|---|---|---|---|
| 46852 | 7/1966 | Fed. Rep. of Germany . | |
| 1601214 | 11/1967 | Fed. Rep. of Germany . | |
| 2642800 | 3/1978 | Fed. Rep. of Germany . | |
| 143817 | 1/1962 | U.S.S.R. | 165/158 |
| 4203 | of 1910 | United Kingdom | 165/158 |
| 111069 | 8/1940 | United Kingdom | 165/158 |
| 982646 | 2/1965 | United Kingdom | 165/163 |
| 1297941 | 11/1972 | United Kingdom . | |

*Primary Examiner*—Robert E. Garrett
*Assistant Examiner*—Carl D. Price
*Attorney, Agent, or Firm*—McGlew & Tuttle

[57] ABSTRACT

A tubular heat exchanger for operation at high gas temperatures and high jacket pressures include tube sheets which are exposed to high loads so that both sheets are kept thin and tie rods bracing the tube sheets are arranged on at least every other graduated circle of a plurality of graduated circles or tubes and tie rods. The heat exchanger tubes arranged between the tube sheets have a helical shape in an intermediate or central region. The heat exchanger design can be used, for example, as a cracked gas cooler.

2 Claims, 1 Drawing Sheet

TUBULAR HEAT EXCHANGER

FIELD AND BACKGROUND OF THE INVENTION

This invention relates in general to heat exchangers, and in particular to a new and useful heat exchanger for operation at high gas temperatures and high jacket pressures, especially a cracked gas cooler tubular heat exchanger with a tube sheet at the gas inlet side and at the gas outlet side, and with heat exchange tubes arranged in graduated circles.

Tubular heat exchangers of this type include a cylindrical jacket that is sealed off by two tube sheets. The cooling tubes, through which the gas flows parallel to the axis of the jacket are, set into the tube sheets. The flow is around the cooling tubes from the outside. Vertical and horizontal heat exchangers are differentiated according to their positions.

The design of the tube sheets presents no particular difficulties. In cracked gas coolers, however, in which the gas inlet temperature is above 800° C. and are subjected to jacket pressures of above 100 bar, the tube sheet on the gas inlet side becomes very hot and therefore has to be made extremely thin to keep the temperature stresses occurring in the sheet small, so that jacket cooling is guaranteed. The protective layer of magnetic forming on the water side during operation, which protects the steel to a great extent against further oxidation, must be retained. Care must therefore be taken that the deformations are kept within limits in spite of high stress to which the tube sheet is exposed, so that this protective magnetic layer is not destroyed.

In cracked gas coolers that have to operate under the aforementioned conditions, and which have been designed with very thin "hot" tube sheets because of the temperature stresses that occur, in order to be able to absorb the loads, tie bolts have been welded to the so-called hot tube sheet perpendicular to its central plane. The bolts are distributed uniformly over the tube sheet surface in tube gases passing through, which were fastened at the other end to very rigid cross bars that are supported on appropriately heavy duty forged rings on the tank jacket.

The so-called cold tube sheet of the cracked gas cooler had thick walls corresponding to its loads. Design calculation on this basis is very tedious.

SUMMARY OF THE INVENTION

It is the purpose of this invention to describe a design for making a cracked gas cooler, especially for the tube sheets of a cooler that are suitable for high gas temperatures and high jacket pressures, that can be produced more economically and with the smallest possible design expense. This is primarily a matter of making the cost intensive tube sheets lighter and more economical with elimination of the forged rings, without thereby reducing the durability of the cracked gas cooler.

The loads occurring with high jacket pressures and gas temperatures can be absorbed harmlessly by the combination of two thin tube sheets proposed by the invention, which are connected to one another by tie rods, and heat exchange tubes that are designed in helical shape over a large region of the longitudinal axis of the heat exchanger. The uniform temperature exposure of the jacket and of the tie rods, that are thus subjected to the same thermal expansion, makes the membrane zone region of the tube sheets previously at risk completely disappear, so that the design calculation expense for the tube sheets in the design pursuant to the invention is limited to the largest area designed between the tie rods and is thus relatively small. The calculations can be limited to the scope of the pertinent engineering rules. The coiled tubes subjected to higher temperatures transmit only a small portion of their thermal expansions as a load on the tube sheets, since most of the expansion is absorbed by the flexibility of the coil.

Thicker and correspondingly expensive components such as those provided for by the design according to the state of the art are not necessary with the invention.

Accordingly it is an object of the invention to provide a heat exchanger for operation at high gas temperatures and high jacket pressures and which may be embodied as a cracked gas cooler comprises a jacket which has a gas inlet end chamber and a gas outlet end chamber each having respective tube sheets through which heat exchanger tubes extend and which includes alternate rows of tubes and tie rods extending between the tube sheets arranged along circles which are graduated with increased numbers of tie rods and tubes proceeding radially outwardly and wherein the tubes are formed substantially straight adjacent each tube sheet but in an intermediate area in which the tubes are bent away from their longitudinal axes into a helical shape.

A further object of the invention is to provide a tubular heat exchanger which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
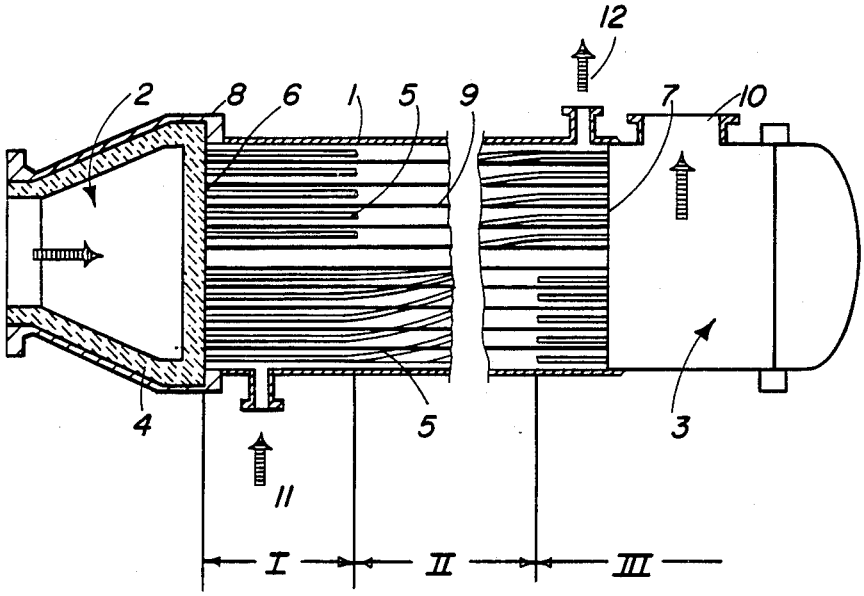
FIG. 1 is an axial cross section through a heat exchanger constructed in accordance with the invention.

Referring to the drawings in particular, the invention embodied therein comprises a heat exchanger which has a pressure resistant jacket 1 in a tube area which is terminated by respective tube sheets 6 and 7 at respective ends which are located adjacent an inlet chamber 2 and an outlet chamber 3.

In accordance with the invention, the ends of the tubes 5 are passed through the associated tube sheets 6 and 7 and they are arranged in radially spaced rows of tubes 5 and tie rods 9 which are graduated with an increased number of associated tubes and tie rods in the rows proceeding radially outwardly. In accordance with a further feature of the invention, the tubes 5 include straight sections or areas adjacent each tube sheet 6 and 7 and have an intermediate area or section designated II in which the tubes are coiled in a helical manner.

FIG. 1 shows a horizontal type heat exchanger that can be used, for example, as a cracked gas cooler. The external structure of the heat exchanger is composed of a pressure-resistant jacket 1 with a pressure-resistant inlet chamber 2 and outlet chamber 3. The inlet chamber 2 has a refractory lining 4. The gas to be cooled flows in the direction of the arrow through the inlet chamber 2 into the tubes 5 of the heat exchanger. The tubes 5 are held in the tube sheets 6 and 7 that are welded into the jacket 1. The forged ring 8, as shown in the embodiment, is necessary only in case of a lined inlet chamber and has dimensions depending on the thickness of the lining 4. The cooled gas is discharged from the outlet chamber 3 to the side through an outlet port 10 in the direction of the arrow.

The cooling medium that flows around the heat exchange tube 5 enters through the infeed port 11, cools the sheet 6, and escapes through the outlet port 12.

Figure 2:
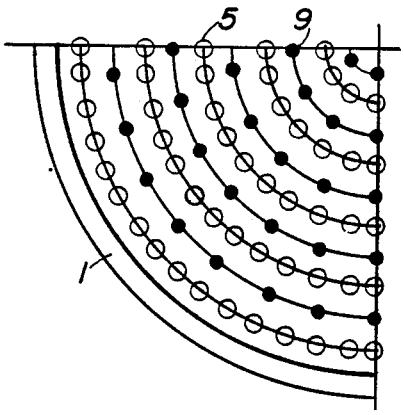
FIG. 2 is a plan projection of a section of a tube sheet.
Figure 3:
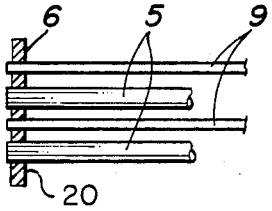
FIG. 3 is an enlarged partial longitudinal view of tubes, tie rods, and tube sheets.

As shown in FIGS. 2 and 3, the heat exchange tubes 5 are arranged in graduated circles on the tube sheets, extending between the tube sheets 6 and 7 along the longitudinal axis of the heat exchanger. The tube sheets 6, 7 are made there corresponding to the requirements for jacket coating stated above, the tube sheets 6, 7 have a ductility of a protective layer of magnetite 20. Tie rods 9 that brace the two tube sheets 6,7 are placed in every other graduated circle.

As indicated in FIG. 1, the heat exchange tubes 5 have a straight shape in the regions I and III, while they are coiled in the region II.

While a specific embodiment of the invention has been shown and described in detail to illustrate the application of the principles of the invention, it will be understood that the invention may be embodied otherwise without departing from such principles.

What is claimed is:

1. A heat exchanger for operation at high gas temperatures and high jacket pressures and especially a cracked gas cooler, comprising a jacket defining an inlet chamber, a tube chamber and an outlet chamber in succession, a tube sheet arranged at an end of said inlet chamber and said outlet chamber respectively, a plurality of tie rods extending between and bracing said tube sheets, and hollow tubular heat exchanger tubes having ends seated in the respective tube sheets, said tubes including straight tubular portions adjacent each tube sheet and an intermediate tubular portion of helical form, said tubes and said tie rods being arranged at a plurality of concentric rows which are graduated so as to provide an increased number of tubes in each successive row proceeding outwardly, said tube sheets being made thin corresponding to requirements for jacket cooling and having a ductility of a protective magnetite layer, said tie rods being arranged in rows alternately with said tubes, said intermediate portion of said tubes being bent away from the longitudinal axis of each tube in a helical form, said straight portion of said tubes adjacent said inlet chamber being greater than the straight portion of said tubes adjacent said outlet tube sheet.

2. A heat exchanger for operation at high gas temperatures and high jacket pressures, especially a cracked gas cooler, comprising a jacket having a gas inlet and a gas outlet and a tubular heat exchanger with a first tube sheet adjacent the gas inlet and a second tube sheet adjacent the gas outlet, the heat exchange tubes being arranged in graduated circles and having ends connected to respective said tube sheets, both of said first and second tube sheets being kept thin corresponding to the requirements of jacket cooling, but with a ductility of a protective magnetite layer being retained, tie rods extending between and bracing said first and second tube sheets on at least every other graduated circle of said first and second tube sheets, said exchange tubes being arranged about said graduated circles, said tubes have an intermediate region bent out of a longitudinal axis of each tube to form a helical shape between said first and second tube sheets, each of said tube having end regions of a straight shape entering respectively said first and second tube sheets and with the straight shape length of said tubes adjacent said first tube sheet being greater than the straight shape length of said tubes adjacent said second tube sheet.

* * * * *